US009003747B2

(12) United States Patent
Cerf

(10) Patent No.: US 9,003,747 B2
(45) Date of Patent: Apr. 14, 2015

(54) PROCESS AND APPARATUS FOR INCREASING STACKING STRENGTH OF FILM WRAPPED ARTICLES

(76) Inventor: Alain Cerf, Pinellas Park, FL (US)

( * ) Notice: Subject to any disclaimer, the term of this patent is extended or adjusted under 35 U.S.C. 154(b) by 526 days.

(21) Appl. No.: 13/453,931

(22) Filed: Apr. 23, 2012

(65) Prior Publication Data

US 2013/0276409 A1 Oct. 24, 2013

(51) Int. Cl.

| | |
|---|---|
| ***B65B 53/02*** | (2006.01) |
| ***B65B 49/00*** | (2006.01) |
| *B65B 49/14* | (2006.01) |
| *B65B 11/00* | (2006.01) |

(52) U.S. Cl.

CPC ..... *B65B 49/00* (2013.01); *B65B 49/14* (2013.01); *B65B 11/00* (2013.01); *B65B 53/02* (2013.01)

(58) Field of Classification Search

CPC ..... B65B 35/00; B65B 49/00; B65B 49/14; B65B 2220/16; B65B 61/20; B65B 61/22; B65B 53/00; B65B 23/00; B65B 13/181; B65B 11/004; B65B 11/50

USPC ..... 53/442, 381, 6, 462, 207, 557, 449, 53/228, 581, 586, 139.7, 139.5, 397, 410, 53/580, 461, 466, 540; 206/521.1, 450, 206/733, 736

See application file for complete search history.

(56) References Cited

U.S. PATENT DOCUMENTS

| | | | | |
|---|---|---|---|---|
| 2,952,105 | A * | 9/1960 | Schur | 53/465 |
| 3,315,435 | A * | 4/1967 | Gunyou | 53/436 |
| 3,656,682 | A * | 4/1972 | Giuliani | 229/125.34 |
| 3,681,893 | A * | 8/1972 | De Barge | 53/209 |
| 3,817,018 | A * | 6/1974 | Vickers | 53/462 |
| 3,872,650 | A * | 3/1975 | Vickers | 53/207 |
| 3,885,374 | A * | 5/1975 | Schmermund | 53/234 |
| 3,896,601 | A * | 7/1975 | Vickers et al. | 53/462 |
| 3,956,874 | A * | 5/1976 | Vickers et al. | 53/207 |
| 4,045,942 | A * | 9/1977 | Muller | 53/48.8 |
| 4,117,646 | A * | 10/1978 | James et al. | 53/488 |
| 4,574,565 | A * | 3/1986 | Gambetti | 53/442 |
| 5,410,862 | A * | 5/1995 | Janhonen | 53/590 |
| 5,678,389 | A * | 10/1997 | Henry | 53/447 |
| 5,884,455 | A * | 3/1999 | Draghetti et al. | 53/466 |
| 5,934,049 | A * | 8/1999 | Cerf | 53/553 |
| 6,141,944 | A * | 11/2000 | Spatafora | 53/466 |
| 6,336,308 | B1 * | 1/2002 | Kokkersvold et al. | 53/447 |
| 6,706,388 | B2 * | 3/2004 | Finestone et al. | 428/343 |
| 7,328,554 | B1 * | 2/2008 | Cerf et al. | 53/465 |
| 7,448,181 | B2 * | 11/2008 | Biondi et al. | 53/234 |
| 7,694,499 | B2 * | 4/2010 | Ballestrazzi et al. | 53/545 |
| 8,037,664 | B2 * | 10/2011 | Squarzoni et al. | 53/466 |
| 2003/0051439 | A1 * | 3/2003 | Lancaster et al. | 53/399 |
| 2004/0261360 | A1 * | 12/2004 | Cere | 53/410 |

(Continued)

*Primary Examiner* — Hemant M Desai
*Assistant Examiner* — Eduardo R Ferrero
(74) *Attorney, Agent, or Firm* — Sam Silverberg

(57) ABSTRACT

The objective of the invention is to provide an alternative way of wrapping a product with cardboard at faster speed and maintain stacking strength. This accomplished by bending two strips of cardboard into the shape of a U channel where the sides of the U form an angle smaller than 90 degrees with the center part of the U form. The sides of the U channel cardboard will be open by a guide that will allow each U channel cardboard piece to slide around each end of the product without requiring glue to hold the U Channel in position. By maintaining an angle of less than 90 degrees the U channel cardboard acts like a spring clamp around the product and maintains its position on the conveyor belt while the product is film wrapped and the film is heat shrunk.

19 Claims, 2 Drawing Sheets

(56) References Cited

U.S. PATENT DOCUMENTS

| | | | | |
|---|---|---|---|---|
| 2004/0261368 | A1* | 12/2004 | Focke et al. | 53/449 |
| 2005/0005580 | A1* | 1/2005 | Spatafora et al. | 53/466 |
| 2005/0076619 | A1* | 4/2005 | Spatafora et al. | 53/466 |
| 2005/0081489 | A1* | 4/2005 | Calugi | 53/461 |
| 2005/0279057 | A1* | 12/2005 | Tale' et al. | 53/466 |
| 2006/0168911 | A1* | 8/2006 | Owen et al. | 53/397 |
| 2007/0227100 | A1* | 10/2007 | Ito et al. | 53/466 |
| 2008/0187428 | A1* | 8/2008 | Murry | 414/788 |
| 2008/0190785 | A1* | 8/2008 | Spivey et al. | 206/147 |
| 2009/0038269 | A1* | 2/2009 | Bertuzzi et al. | 53/466 |
| 2009/0183467 | A1* | 7/2009 | Rapp et al. | 53/370.2 |
| 2013/0276409 | A1* | 10/2013 | Cerf | 53/442 |

* cited by examiner

PROCESS AND APPARATUS FOR INCREASING STACKING STRENGTH OF FILM WRAPPED ARTICLES

FIELD OF INVENTION

This invention relates to providing packing strength to products that have been wrapped with heat shrink film. The product can be a single item or a bundle of items.

BACKGROUND OF THE INVENTION

A material, such as a corrugated cardboard, has been used to wrap a product to provide stacking strength. The single piece of cardboard when wrapped around the product requires using glue to hold the cardboard around the product. The single piece is very long and difficult to bend or prebend during the wrapping of the product. To accommodate the wrapping of the product with the single piece of cardboard requires that the film wrapping machine slows down from its normal speed.

SUMMARY OF THE INVENTION

The objective of the invention is to provide an alternative way of wrapping a product with cardboard at faster speed and maintain stacking strength. This accomplished by bending two strips of cardboard into the shape of a U channel where the sides of the U form an angle smaller than 90 degrees with the center part of the U form. The sides of the U channel cardboard will be open by guides that will allow each U channel cardboard piece to slide around each end of the product without requiring glue to hold the U Channel in position. By maintaining an angle of less than 90 degrees the U channel cardboard acts like a spring clamp around the product and maintains its position on the conveyor belt while the product is film wrapped and the film is heat shrunk.

DETAILED DESCRIPTION OF THE INVENTION

Figure 1:
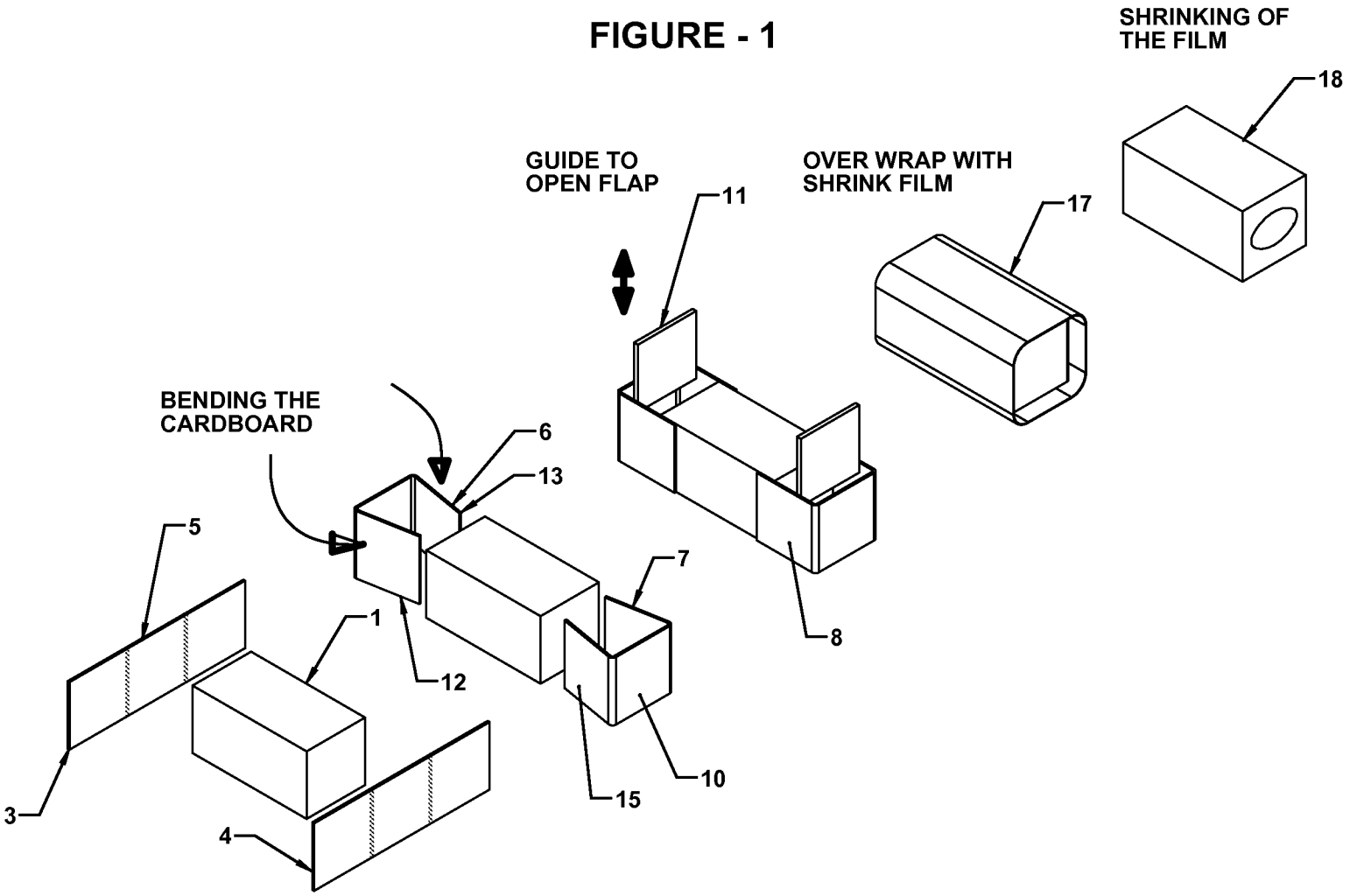
FIG. 1 shows the inserting card board material onto a product.

FIG. 1 shows a product 1 moving on a conveyor 2. The product 1 can be a bundle of articles or a single article. On each side of the product 1, two corrugated cardboard pieces 3 and 4 located on the side of the conveyor. The card board is manufactured to a size to accommodate the product as shown by 8 and 9. The cardboard pieces have score lines or slots 5 that enable the cardboard to be bend into a position shown as 6 and 7. In synchronization with the movement of the product 1, cardboards 3 and 4 are moved into a position where the are bent into U channel 10 where side sections 12 and 13 of the U are bend to an angle less than 90 degrees with the center part of the U form. As the product moves further on the conveyor, a guide 11 separates the sections 12 and 13 to an angle that will allow the U shaped cardboard to be pushed on the product 1. Afterward the conveyor stops allowing the U channel to be pushed onto the product 1. A pushing means such as an air cylinder can be used to push the cardboard U channel so the channel slides on to the product 1. Guides 11 are removed, causing sections 12 and 13 to act like a spring clamp by pressing against the sides of the product 1 to maintain the cardboard in its proper position. An alternative to stopping the conveyor for pushing the The U channel, the U channel can be pushed onto the product while the conveyor is moving.

After the two cardboard pieces are placed in their proper position the conveyor moves the product to a film wrapping station 17 where a heat shrink film wraps the product with the card board. After wrapping the conveyor moves the product thru a heat tunnel station 18 where the film is heat shrunk around the product.

Any mechanical device capable of separating sections 12 and 13 and pushing the cardboard into its final position can be used. The lengths of sections 12 and 13 can be adjusted to allow for an opening so that users can see the product thru the heat shrink film. The cardboard can be substituted by any other material that will act to strengthen the stacking strength and have the mechanical ability to act as a spring clamp to maintain the material in its proper position on the moving conveyor.

Figure 2:
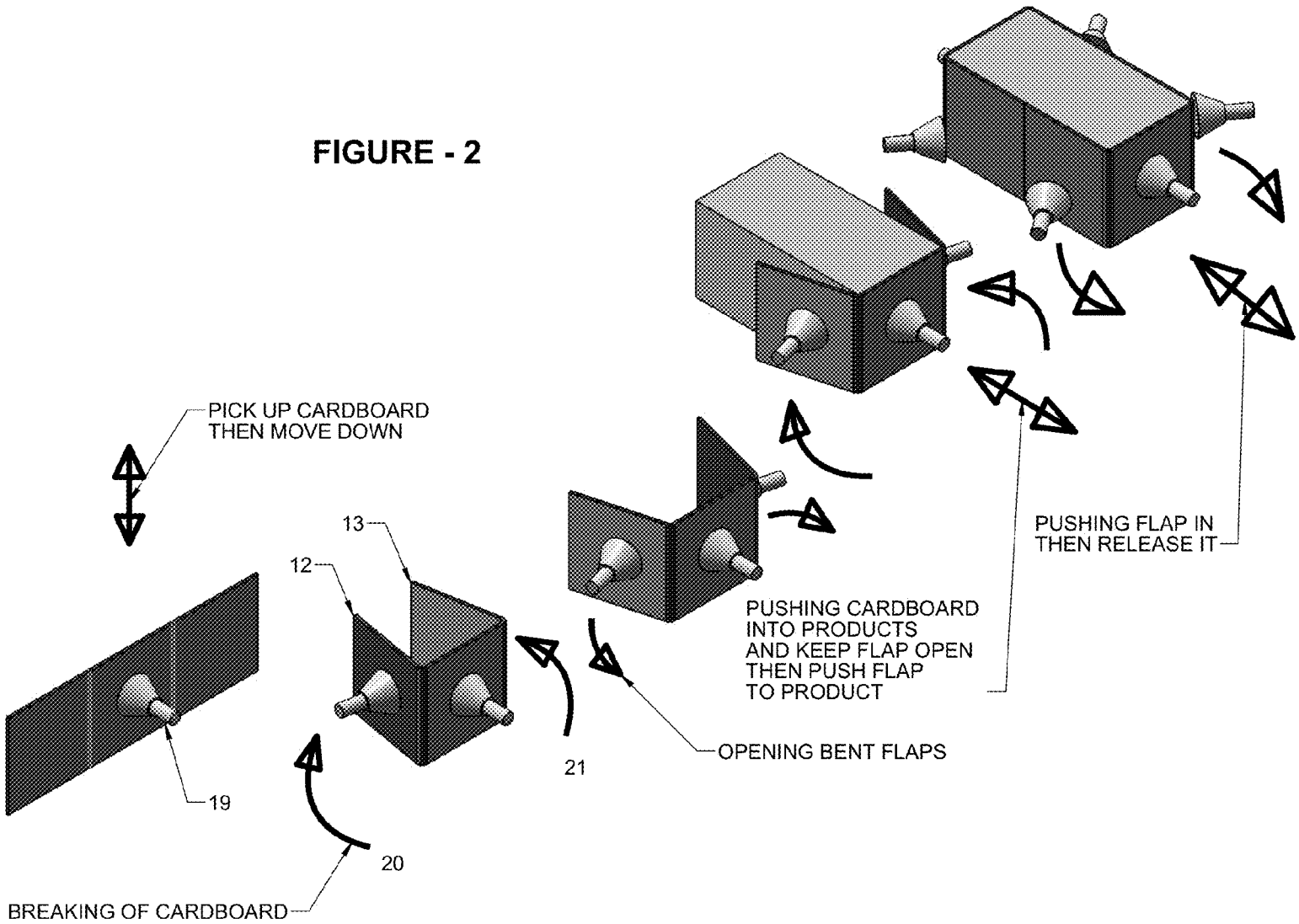
FIG. 2 shows suction cups moving the cardboard and controlling the movement of the sides of the card board

FIG. 2 shows a suction cup 19 picking up a cardboard sheet 4 and moving the sheet to the side of the conveyor in preparation for bending the cardboard. Suction cup 19 moves cardboard sheet 4 in synchronization with the movement of the product. Suction cups 20 and 21 bend the sides (flaps) 12 and 13 to an angle less than 90 degrees with the center part of the U form and then suction cups opens the bend sides greater than 90 degrees thereby allowing the suction cup 19 to push the cardboard onto the product. After the cardboard is pushed into the product, suction cups 20 and 21 pushes the sides against product and then releases the sides. The bend sides (flaps) presses against the product and remains in its final position on the conveyor.

The invention claimed is:

1. A process for providing packing strength to a product moving on a conveyor prior to film wrapping and heat shrinking the product comprising:

moving a product on a conveyor, providing a material that will increase the stacking strength of the product, bending the material into a U channel where each side of the channel is at an angle of less than 90 degrees with the center part of the U form, separating the sides of the U channel to accommodate the sides of the product, pushing the U channel with the separated sides onto the product to provide stacking strength, film wrapping the product with the U channel, and heat shrinking the film.

2. A process according to claim 1 wherein two U channels having separated sides are provided and each U channel is pushed onto the product from opposite ends.

3. A process according to claim 2 including providing the length of the sides of the channel so that an opening is formed whereby a user can see the product.

4. A process according to claim 2 wherein a guide is used to separate the sides of the channel.

5. A process according to claim 2 wherein the material is corrugated cardboard.

6. A process according to claim 1 wherein an air cylinder pushes the U channel onto the product.

7. A process according to claim 2 wherein the U Channel material is moving in synchronization with the movement of the product on the conveyor.

8. A process according to claim 2 including stopping the conveyor so that the U channel can be pushed onto the product.

9. A process according to claim 2 including pushing each side of the U channel against the product.

10. A process according to claim 1 wherein glue is used to hold the U channel in position.

11. An apparatus for providing packing strength to a product moving on a conveyor prior to film wrapping and heat shrinking the product comprising, conveyor means to move a product, means for providing a material that will increase the stacking strength of the product, means for bending the material into a U channel where each side of the channel is at an angle of less than 90degrees with the center part of the U form, means for separating the sides of the U channel to accommodate the sides of the product, means for pushing the U channel with the separated sides onto the product to provide stacking strength, means for film wrapping the product with the U channel, and means for heat shrinking the film.

12. An apparatus according to claim 11 wherein the means for pushing pushes two U channels having separated sides where each U channel is pushed onto the product from opposite ends.

13. An apparatus according to claim 11 wherein the length of the sides of the channel has an opening whereby a user can see the product.

14. An apparatus according to claim 11 wherein the means for separating is a guide that separate the sides of the channel.

15. An apparatus according to claim 11 wherein the material is a corrugated cardboard.

16. An apparatus according to claim 11 where in an air cylinder pushes the U channel onto the product.

17. An apparatus according to claim 11 including means for moving the U Channel material in synchronization with the movement of the product on the conveyor.

18. An apparatus according to claim 11 including means for stopping the conveyor so that the U channel can be pushed onto the product.

19. An apparatus according to claim 11 wherein the means for bending the material into a U channel where each side of the channel is at an angle less of than 90 degrees with the center part of the U form includes means for increasing the angle to more than 90 degrees so that the channel can be pushed against the product.

* * * * *